United States Patent [19]

Arasmith

[11] Patent Number: 4,785,860

[45] Date of Patent: Nov. 22, 1988

[54] WOOD PROCESSING MACHINE HAVING ANNULAR RINGS

[76] Inventor: Stanley Arasmith, P.O. Box 2458, Rome, Ga. 31064

[21] Appl. No.: 99,338

[22] Filed: Sep. 18, 1987

Related U.S. Application Data

[63] Continuation-in-part of Ser. No. 917,855, Oct. 14, 1986.

[51] Int. Cl.[4] ..... B27C 1/00

[52] U.S. Cl. ..... 144/174; 144/172; 241/294; 407/58

[58] Field of Search ..... 241/91, 92, 294, 296; 407/49, 58, 59; 144/162 R, 172, 176, 221, 241, 230, 218

[56] References Cited

U.S. PATENT DOCUMENTS

| | | | |
|---|---|---|---|
| 3,355,113 | 11/1967 | Meger et al. | 241/294 |
| 3,801,027 | 4/1974 | Kubitz | 144/172 |
| 4,077,450 | 3/1978 | Ackerman | 144/172 |
| 4,607,672 | 8/1986 | Kangas et al. | 144/162 R |

*Primary Examiner*—W. Donald Bray

*Attorney, Agent, or Firm*—Jones, Askew & Lunsford

[57] ABSTRACT

An apparatus for processing wood, comprising a cylindrical drum mounted for rotation about its longitudinal axis, a cutting member, means for mounting the cutting member upon the circumferential surface of the drum such that its cutting edge is positioned a first distance from the drum surface, means for rotating the drum such that the cutting element passes along a circular path concentric to the surface of the drum, a pair of parallel ring sections each having a first and a second end and a substantially uniform cross section, and having an arcuate configuration along their length substantially conforming to the circumferential surface of the surface of the drum, the first ends of the spacing elements being positioned laterally adjacent to the path of travel of the cutting member, and extending in parallel relationship in front of the cutting member such that a gullet is defined in front of the cuting edge by the cutting member, the ring sections, and the surface. A repeating pattern exists for the placement of the rings and cutting members upon the surface of the drum.

13 Claims, 8 Drawing Sheets

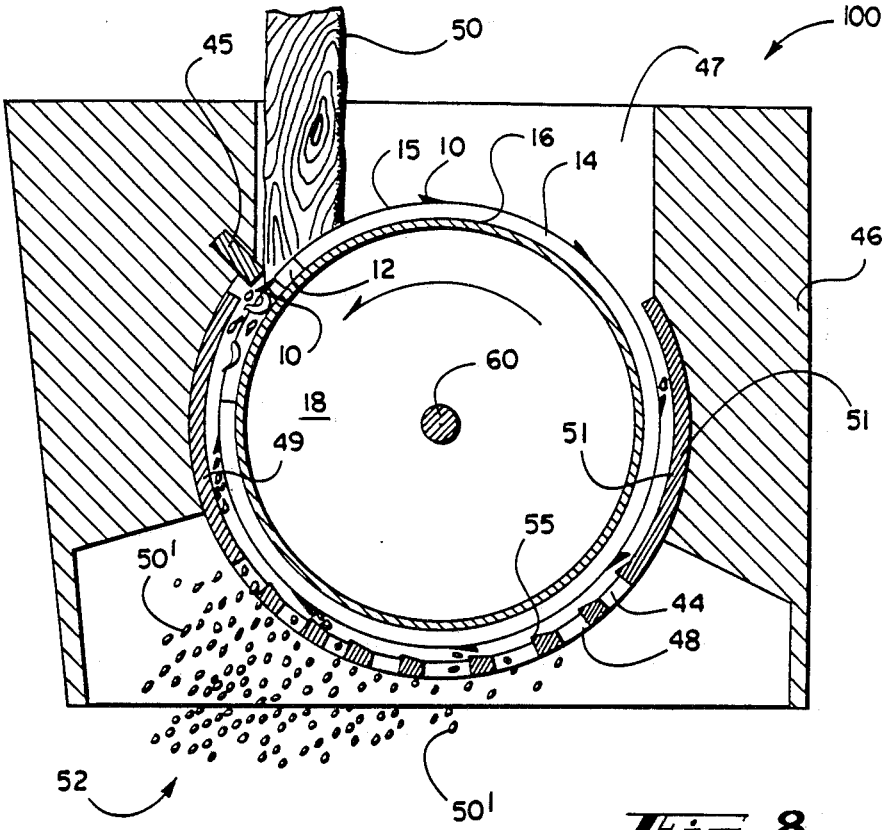
Fig. 8
Fig. 9
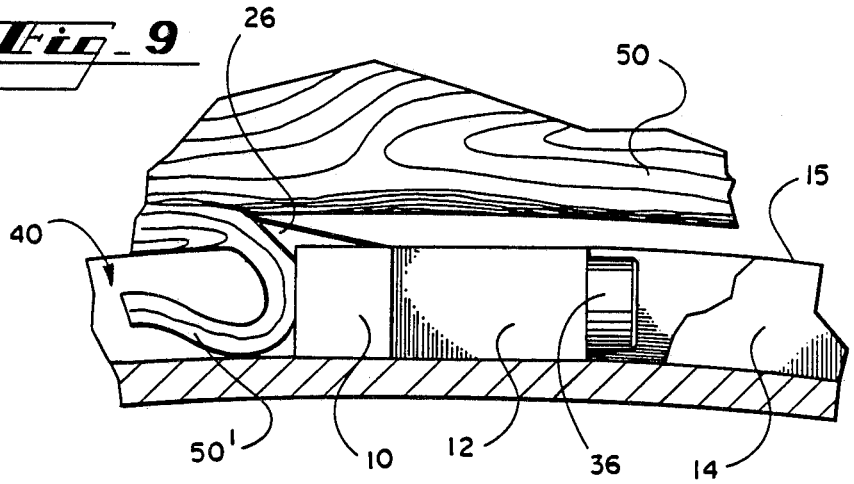

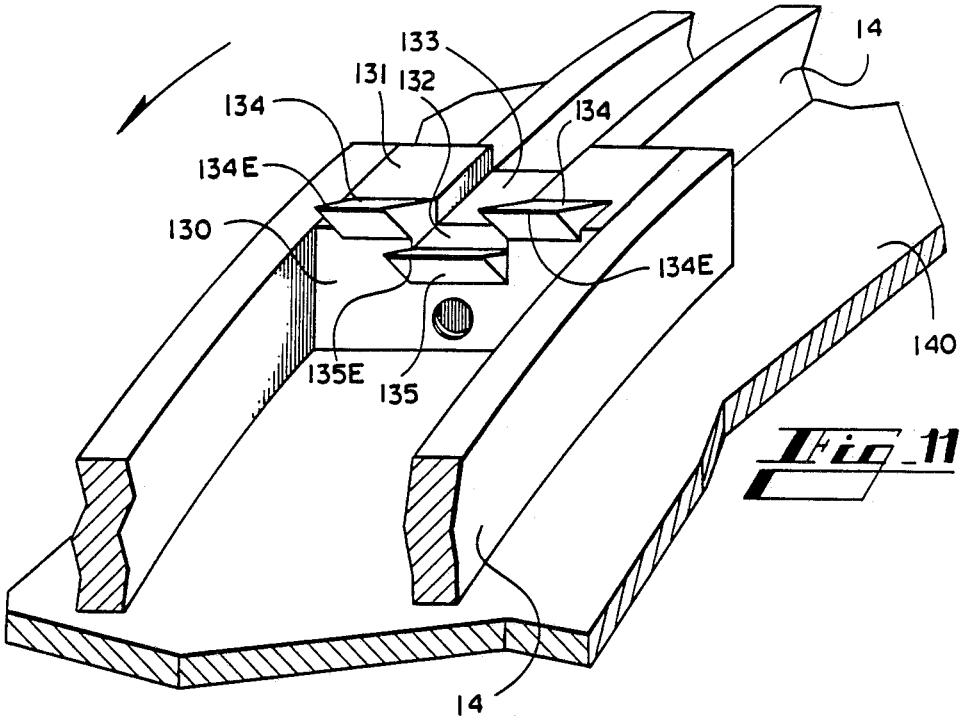
Fig_11
Fig_12
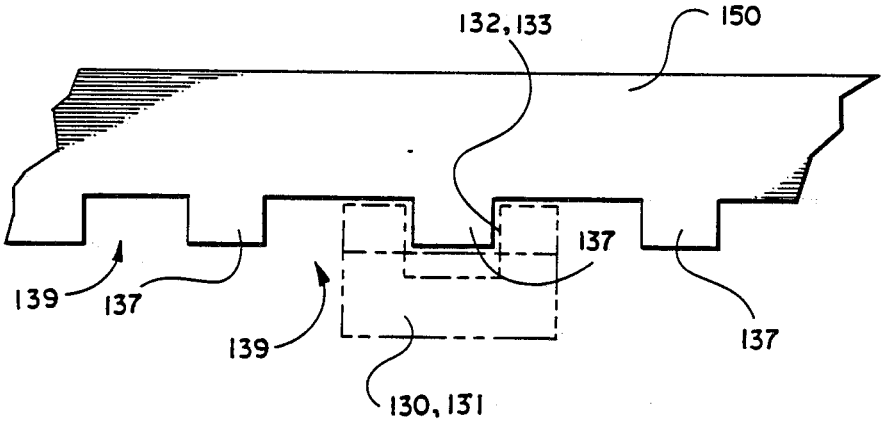

WOOD PROCESSING MACHINE HAVING ANNULAR RINGS

RELATED APPLICATIONS

This is a continuation-in-part of applicant's pending application Ser. No. 917,855, filed Oct. 14, 1986, incorporated herein by reference issued.

TECHNICAL FIELD

The present invention relates to the processing of wood, usually in the form of logs or brush, and more particularly relates to an improved apparatus which allows for efficient reduction of the wood into wood chips flakes, or small shredded pieces, which may ultimately be used as mulch, fuel, potting soil or animal bedding.

BACKGROUND ART

In known wood processing machines used to convert logs into chips or flakes, it has been common for the machines to include one or more cutting members mounted either on the face of a rotating disk or on the circumferential surface of a rotating drum. During operation of the machines, wood members are guided or urged into the rotating disk or drum so that the knife-like cutting members cut away chips or flakes from the wood members, and the wood members are ultimately consumed.

Such prior art cutting members are typically configured to cut a rectangular or similar cross-section out of the wood members. However, many of these configurations do not allow for efficient cutting of the wood, as they require large surges of power during the cutting stage, which necessitates the use of large motors. Therefore such prior art devices tend to be large, heavy, and expensive. Prior art devices also typically utilize cutting members which are partially recessed within the disk or drum. Although this configuration results in a structurally effective attachment between the cutting members and the disk or drum, it is disadvantageous if unprocessable foreign material is present with the wood. When such foreign material is encountered, prior art machines typically jam, and the risk of extensive and costly damage to the machine is high. One example of such recessed cutter mounting configurations is shown in applicant's U.S. Pat. No. 4,444,234 incorporated herein by reference, which discloses the use of a drum having a plurality of the knives mounted within recesses in a rotating drum. Other recessed-knife configurations are disclosed in U.S. Pat. Nos. 867,275 to Hunter, 953,630 to Lindley, 1,311,452 to Lovejoy, 3,059,676 to Kiser, 3,463,206 to Briggs, and 4,492,140 to Pano.

The presence of unprocessable material is a particular problem in processing stumps, brush and other material of the kind remaining on the site of a logging operation. Wood "hogs" used to shred such material are subject to considerable down time and damage to cutting elements when the latter encounter rocks, metal or the like. Cutting members in the past have been expensive to manufacture and sharpen, and have been resharpened for additional use. Significant expenditures of time and money have been necessary to remove the cutting members, sharpen all their edges, and reinstall them into the machine. An example of such resharpenable cutting members is shown in applicant's U.S. Pat. No. 4,569,380 incorporated herein by reference, which discloses the use of a cutting element having a plurality of resharpenable cutting elements.

It has also been known to provide such wood processing machines with cavities provided immediately in front of the cutting members, thus allowing wood chips removed by the cutting members to fall downwardly into the cavities after being cut. Such a configuration prevents the wood chips from piling up in front of the cutting member when a large wood member is encountered, thus disadvantageously pushing such a wood member outwardly and impeding the cutting action of the cutting members. Such a configuration is shown in U.S. Pat. No. 3,304,970, in FIG. 10, in which cavities 41A are provided to accept wood chips removed by cutting members 24 to accumulate during the cutting operation, only to be discharged after the particular knife associated with the particular gullet has completed its cut. U.S. Pat. No. 2,710,635, FIG. 1, also discloses cavities (not numbered) positioned in front of cutting members 25 which also accept wood chips cut from a wood member 10. Similar configurations are shown in U.S. Pat. Nos. 3,195,593 to Hall, and 2,951,518 to Cumpston, Jr. Another similar means of removing wood chips is shown in U.S. Pat. No. 3,732,907, to Nystrom, FIG. 3, in which holes 20 are provided in front of cutting members 30, which allow wood removed from wood member 14 to pass through the disc and away from the cutting members. A similar configuration is shown in U.S. Pat. No. 3,746,062 to Nystrom.

Therefore it may be seen that a need exists in the wood processing art for an apparatus which facilitates power-efficient cutting and shredding of wood products. It may also be seen that a need also exists for a wood processing apparatus which does not become clogged with processed material. A need also has existed for a wood processing machine which is subject to a minimum of damage when encountering unprocessable foreign material, and has disposable cutting members that can be replaced with a minimum of time and effort. Finally, the need always exists for such apparatuses to be simple to operate, and inexpensive to purchase and maintain.

SUMMARY OF THE INVENTION

The present invention provides an apparatus which facilitates power-efficient cutting and shredding of wood products. The present invention also provides a wood processing machine which includes cutting members which are inexpensive to manufacture and are readily replaced in the field.

Generally described, the invention is directed toward an apparatus for processing wood, comprising a supporting surface, means for maintaining a wood member spaced apart from the surface, a cutting element for engaging the wood member, the cutting element defining a cutting edge and being mounted to the surface such that the cutting edge is spaced apart from the surface a distance greater than the distance at which the wood member is maintained from the surface, such that the depth of cut of the cutting element into the wood member is generally the difference in the second and the first distances.

Described in more detail, the invention is directed toward an apparatus for processing wood, comprising a supporting surface, a pair of spacing elements mounted on the surface for maintaining a wood member spaced apart a first distance from the surface, the spacing elements and the surface combining to define a gullet having a depth of the first distance, a cutting element positioned within the gullet and having a cutting edge extending a second distance apart from the surface, the second distance being greater than the first distance, such that the depth of cut of the cutting element into the wood member is generally the difference in the second and the first distances, means for urging the cutting member relative to the wood member such that the cutting edge engages the wood member and removes a reduced wood element from the wood member, and means for directing the reduced wood element into the gullet and away from the cutting edge.

Described in even further detail, the invention is directed toward an apparatus for processing wood, comprising a cylindrical drum mounted for rotation about its longitudinal axis, a cutting member having a cutting edge, means for mounting the cutting member upon the circumferential surface of the drum such that the cutting edge is positioned a first distance from the circumferential surface, means for rotating the drum such that the cutting element passes along a circular path concentric to the surface of the drum, a pair of parallel elongate ring sections each having a first and a second end and a substantially uniform cross section, and having an arcuate configuration along their length substantially conforming to the circumferential surface of the surface of the drum, the first ends of each of the spacing elements being positioned laterally adjacent to the path of travel of the cutting member, and extending in parallel relationship in front of the cutting member such that a gullet is defined in front of the cutting edge by the cutting member, the ring sections, and the surface.

Thus, it is an object of the present invention to provide an improved wood cutting member.

Thus, it is an object of the present invention to provide a wood cutting member which may be used on a drum- or disc-type cutting apparatus.

It is a further object of the present invention to provide a wood cutting member that penetrates into the wood with a reduced power requirement.

It is a further object of the present invention to provide a wood cutting member which producing a consistent wood chip product.

It is a further object of the present invention to provide a wood cutting member which is inexpensive to manufacture and install.

It is a further object of the present invention to provide a wood cutting member which is disposable.

It is a further object of the present invention to provide a wood cutting member which may be used with a toothed anvil.

It is a further object of the present invention to provide an improved means of securing a cutting member upon a supporting surface.

It is a further object of the present invention to provide an improved wood cutting apparatus.

It is a further object of the present invention to provide a wood cutting apparatus does not become clogged with processed material.

It is a further object of the present invention to provide a wood processing apparatus which provides a processed product having a consistent size.

Other objects, features, and advantages of the present invention will become apparent upon review of the following detailed description of embodiments of the invention, when taken in conjunction with the drawings.

BRIEF DESCRIPTION OF THE DRAWINGS

FIG. 7 is a flat projection of one half of the surface of the drum of FIG. 6.

FIG. 8 is a side cross section plan view of the wood processing apparatus of the present invention.

FIG. 9 is a isolated side cross section view of a cutting member, support block, and associated ring members along line 9—9 of FIG. 7, illustrating the engagement of the cutting member into a typical wood member.

FIG. 11 is a view similar to that of FIG. 2, illustrating the cooperation of an alternative cutting member and support block configuration with the annular rings and supporting surface of the rotating drum.

FIG. 12 is an illustrative view of the cooperation of a toothed anvil with the alternative cutting member of FIG. 11, showing the alternative cutting member in phantom.

DETAILED DESCRIPTION OF THE INVENTION

Figure 1:
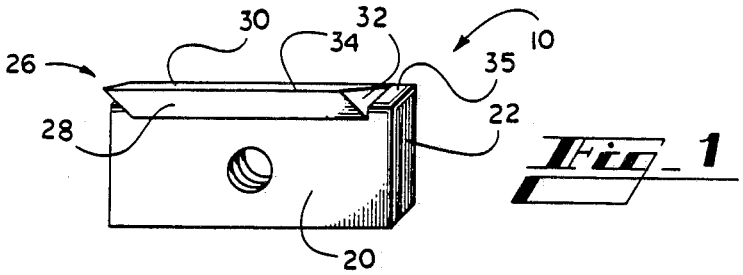
FIG. 1 is an isolated pictorial view of the cutting member 10 of the present invention.

Referring now to the drawings, in which like numerals represent like parts throughout the several views, a general overview of the overall operation of a wood processing apparatus 100 according to a first embodiment is first discussed, with general reference to FIGS. 1–10. The wood processing apparatus 100 includes a cylindrical rotating drum 18 which supports a plurality of cutting members 10 and ring segments 14 upon its circumferential surface. As the rotating drum 18 rotates, wood members 50 inserted into the hopper 47 of the wood processing apparatus 100 are drawn toward a stationary anvil 45 by the cutting members. Eventually the wood members 50 are stopped by the anvil 45 and the cutting members 10 cut through the wood members and create reduced wood elements which will be referred to as wood chips 50'. The wood chips 50' are drawn downwardly by the cutting members and gravity toward a separating grate 48. Chips 50' too large to exit the apparatus 100 through the grate 48 are drawn upwardly by the cutting members back to the hopper 47 to be reprocessed. Chips 50' which pass through the grate 48 are conveyed away from the apparatus by a conveying means (not shown). A more detailed description of the apparatus is now set forth below.

CUTTER CONFIGURATION

Figure 2:
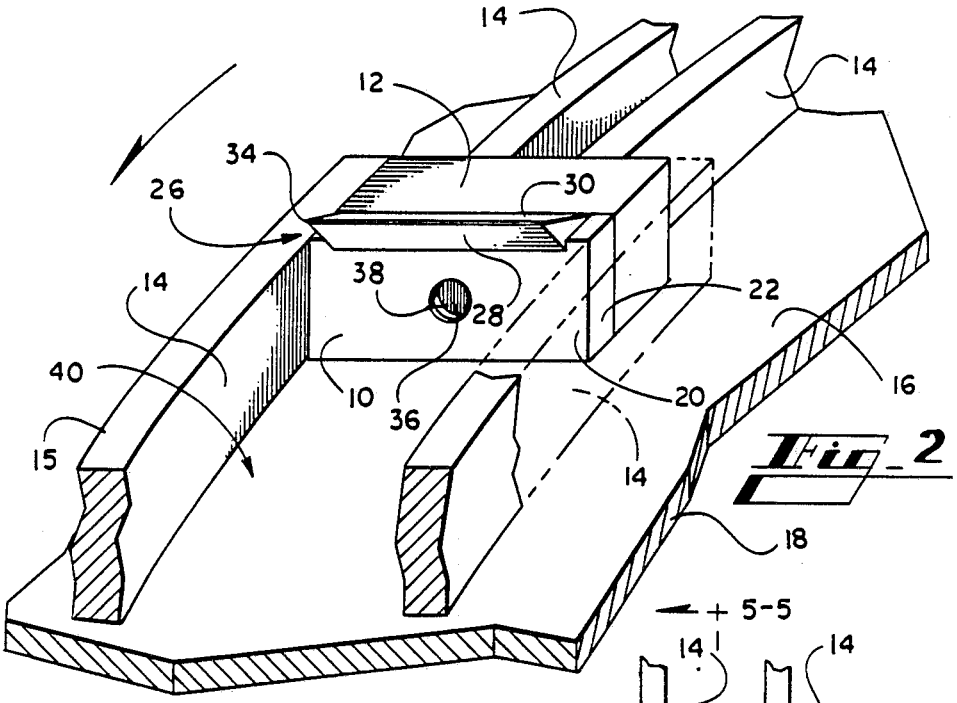
FIG. 2 is an isolated pictorial view of the cutting member, support block, and ring segments of the present invention, illustrating the cooperation of the above elements on the surface of an isolated section of the drum.
Figure 3:
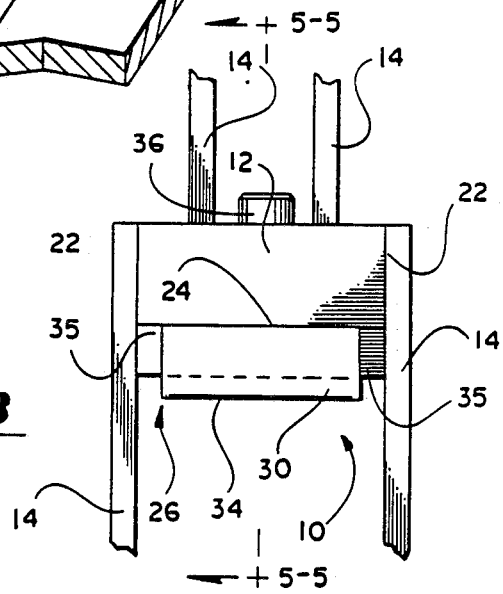
FIG. 3 is a top plan view of the elements shown in FIG. 2, except the surface of the drum is not shown.

FIG. 2 shows the cutting member 10 of the present invention as it cooperates with a support block 12 and annular ring segments 14, all of which are positioned atop the circumferential supporting surface 16 of a rotating drum 18. As shown in FIGS. 1–5, the cutting member 10 includes a leading face 20, side faces 22, a trailing face 24, and a blade 26 having a leading face 28, a heel face 30, two vertical side faces 32, and a cutting edge 34. The width of the blade 26 is somewhat less than the overall width of the cutting member 10, such that a pair of ledges 35 protrude on opposing sides of the base of the blade 26. The planar surfaces of leading and trailing faces 20, 24, are substantially parallel, and the planar surfaces of ledges 35 are mutually coplanar, and perpendicular to the planar surfaces of leading and trailing faces 20, 24. The planar surfaces of side faces 22 are substantially parallel, and are also perpendicular to the planar surfaces of leading and trailing faces 20, 24. The blade 26 and remainder of the cutting member 10 are preferably cast as a single member.

Figure 5:
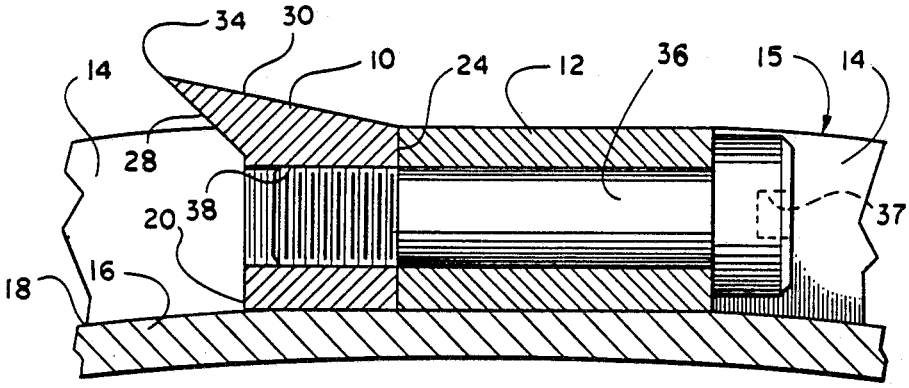
FIG. 5 is a radial cross sectional view along line 5—5 of FIG. 3.

Referring now to FIGS. 2 and 5, the cutting member 10 is attached to the support block 12 by a bolt 36 which extends through the support block 12 and threadably engages cutting member 10 at 38. The head of the bolt 36 defines a hex key cavity 37. The support block 12 is attached by weldments or other fastening means known in the art to the supporting surface 16 of drum 18. It may be seen that the trailing face of the cutting member 10 is in direct contact with the leading face of the support block 12 when the two are in place on the drum.

The arcuate ring segments 14 are, in the first preferred embodiment, formed from lengths of metal bar having a substantially rectangular transverse cross-section. These metal bars, prior to being formed into the arcuate ring segments 14, each have a pair of parallel major side faces, a pair of parallel minor side faces perpendicular to the major side faces, and two parallel end faces each perpendicular to the major side faces and also to the minor side faces. These lengths of metal bar are then bent by means known in the art such that the major side faces remain substantially flat, yet the minor side faces assume an arcuate configuration with one face being similar in contour to the outside perimeter surface of the drum 18. This configuration is the final configuration of the ring segments 14. When in place, as illustrated by FIGS. 2, 4–10, the ring segments stand up on one edge and substantially follow the arcuate contour of the supporting surface 16 of the drum 18, with the ring segments defining an upper surface 15 spaced apart from the surface of the drum. As will be discussed in greater detail later in this application, each ring segment 14 cooperates at each of its ends with a different cutting member 10.

RING-CUTTER COOPERATION

For purposes of illustration, when the term "leading" is used, it is used in reference to the direction of travel of various elements of the wood processing apparatus 100 with respect to stationary wood that is cut by the apparatus. For example, a "leading" edge of a particular element will pass through a wood member prior to the "trailing" edge of the same element. Similarly, a leading face of a particular element, as compared to its trailing face, is a face which faces the wood member during approach of the element towards the wood member. The "trailing" face would be that face facing the wood member after the cutting member has passed through the wood member.

Figure 4:
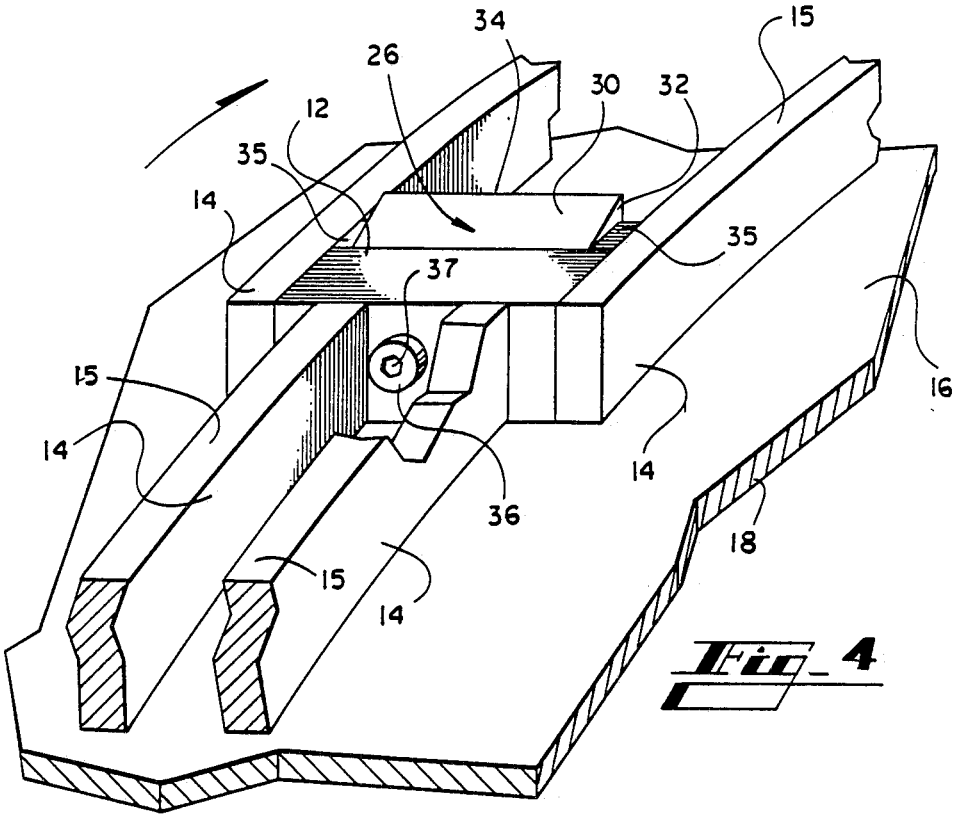
FIG. 4 is an isolated pictorial view of the elements shown in FIG. 2, viewed from a different orientation.

Referring now to FIGS. 2 and 4, the cooperation between one particular cutting member 10, a support block 12, and ring segments 14 will be discussed. The cooperation between all cutting members 12 and all ring segments 14 will be discussed later in this application.

As shown best in FIG. 2, a pair of parallel ring segments 14 extend alongside and in front of each cutting member 10 such that a "gullet" 40 is provided in front of the cutting members by the pair of ring segments 14, the leading face 20 of the cutting member, and the supporting surface 16 of the drum 18. The importance of such a gullet will be discussed later in this application. As shown in FIG. 4, a second pair of parallel ring segments 14 abut the trailing face of the support block 12. Therefore it may be seen that two pairs of ring segments 14 cooperate with each cutting element and support block.

The ring segments 14 are attached to the supporting surface 16 of the drum 18 by welding or other similar means known in the art. The ring segments 14 may also be welded to the support block if desired. However, the ring segments should not be welded to the cutting member 10, if it is desired to occasionally remove the cutting member 10 from the surface of the drum 18 for replacement or resharpening.

Therefore it may be seen that the cutting element is nested between two ring segments 14. As discussed in detail further in this application, the ring segments each define an upper surface 15 which is substantially concentric with the drum supporting surface 16. The blade 26 of the cutting member 10 extends above the upper surface 15 of the ring segments 14, such that the cutting edge 34 is spaced a first distance away from the supporting surface 16, and the upper surface 15 is spaced apart from the supporting surface 16 a second distance being less than the first distance. As discussed in further detail later in this application, the blade 26 engages a wood member at a depth approximating the difference in the first and second distances discussed above.

OVERALL PATTERN OF COOPERATION BETWEEN CUTTERS AND RING SEGMENTS

Figure 6:
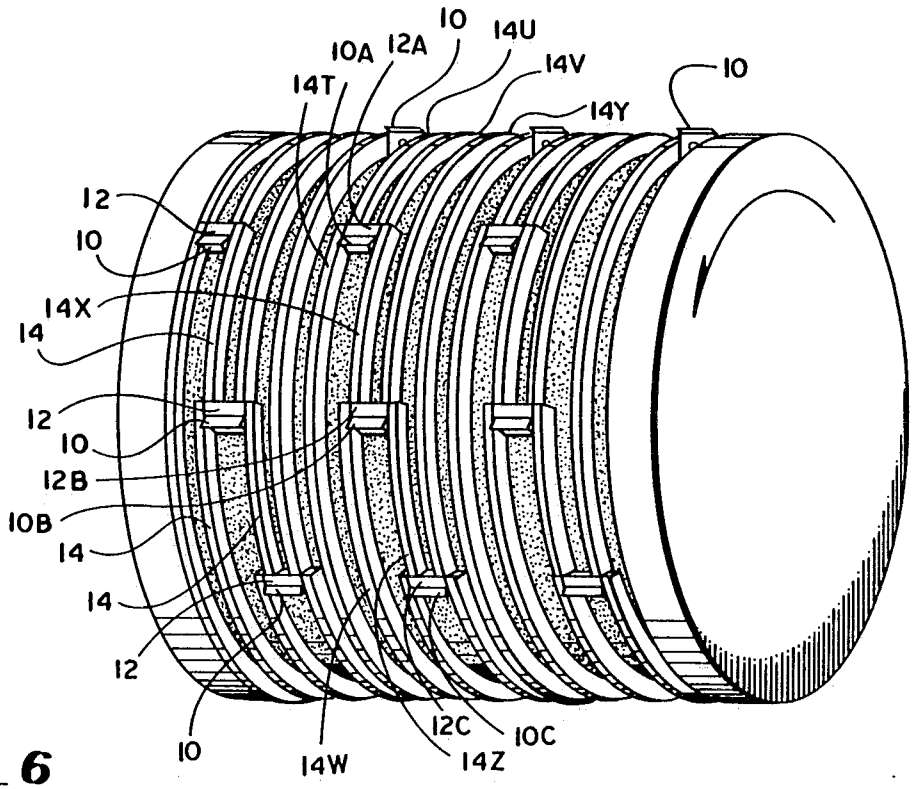
FIG. 6 is an isolated pictorial view of the rotating drum of the present invention.
Figure 1:
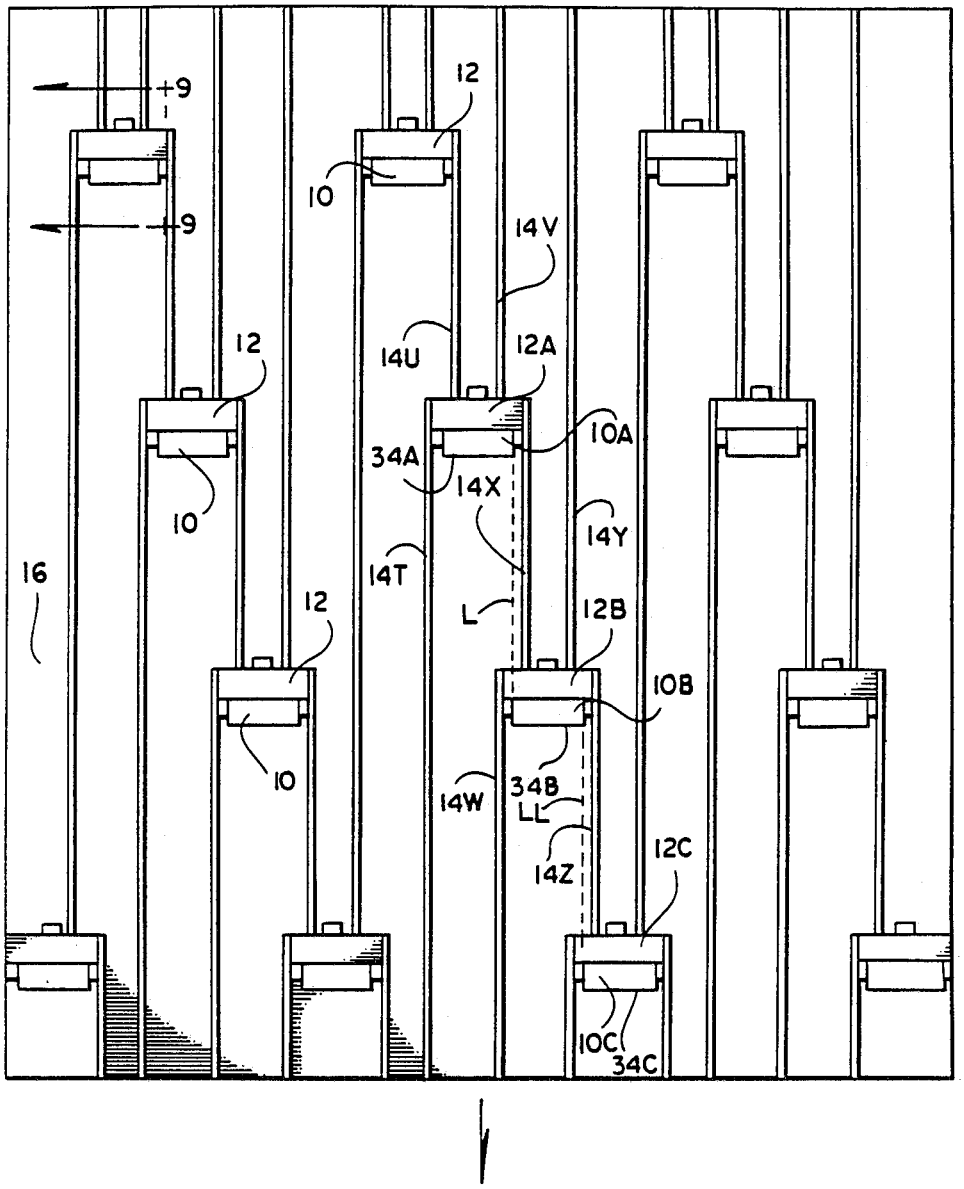

The cooperation between all of the cutting members 10, support blocks 12, and ring segments 14 on the drum 18 is now discussed. As shown in FIGS. 6 and 7, one end of each of the ring segments 14 abuts the trailing face of one support block 12, and a second end is situated alongside a second support block 12 and corresponding cutting member 10. For purpose of illustration, in FIGS. 6 and 7 particular cutting members 10 have been designated as cutting members **10*a*, 10*b*, and 10*c*, corresponding support blocks 12 have been designated as support blocks 12*a*, 12*b*, and 12*c*, and associated ring segments 14 have been designated as ring segments 14*t*, 14*u*, 14*v*, 14*w*, 14*x*, 14*y*, and 14*z***. This designation scheme will illustrate the particular cooperation between the above elements, and illustrate how this cooperation forms a repeated pattern on the surface of the drum.

Ring segment **14*t* has a trailing end which is situated alongside the left sides (as viewed in drawings 6 and 7) of the cutting member 10*a* and corresponding support block 12*a*. Ring segments 14*u*, 14*v* are parallel to each other and each have their leading end abutting the trailing face of the support block 12*a* (this abutting configuration may be seen more particularly in FIG. 4). Ring segment 14*x* has a trailing end which is alongside the right hand sides (as viewed in the drawings) of the cutting member 10***a*, and support block 12*a*. The leading end of ring segment 14*x* abuts the trailing face of support block 12*b*, as does the leading end of ring segment 14*y*. It may be seen that the leading end of ring segments 14*x*, 14*y* abut the trailing face of the support block 12*b* in a similar manner to manner in which the leading ends of ring segments 14*u*, 14*v* abut the trailing face of support block 12*a*, as previously discussed.

The trailing end of ring segment 14*w* is situated along the left sides of the cutting member 10*b* and corresponding support block 12*b*, in a manner similar to the positioning of the trailing end of ring segment 14*t* is positioned relative to cutting member 10*a* and support block 12*a*. The trailing end of ring segment 14*z* similarly is positioned relative to cutting member 10*b* and support block 12*b* as the trailing end of ring segment 14*x* is positioned relative to cutting members 10*a* and support block 12*a*.

Therefore it may be seen that a repeating pattern exists for the positioning of the cutting members 10, support blocks 12, and ring segments, and that for most ring segments 14, the leading end of a ring segment 14 abuts the trailing face of a first support block 12, and the trailing end of the same ring segment 14 is positioned on one side of a second support block 12 and an associated cutting member 10. Such second support block is th next adjacent support block moving axially along the drum, although it is angularly displaced such that the support blocks and cutting members form a helical pattern. For a few ring segments situated at the extreme edges of the drum 18, however, it may be seen that such is not the case as the repeating pattern is required to terminate.

Figure 10:
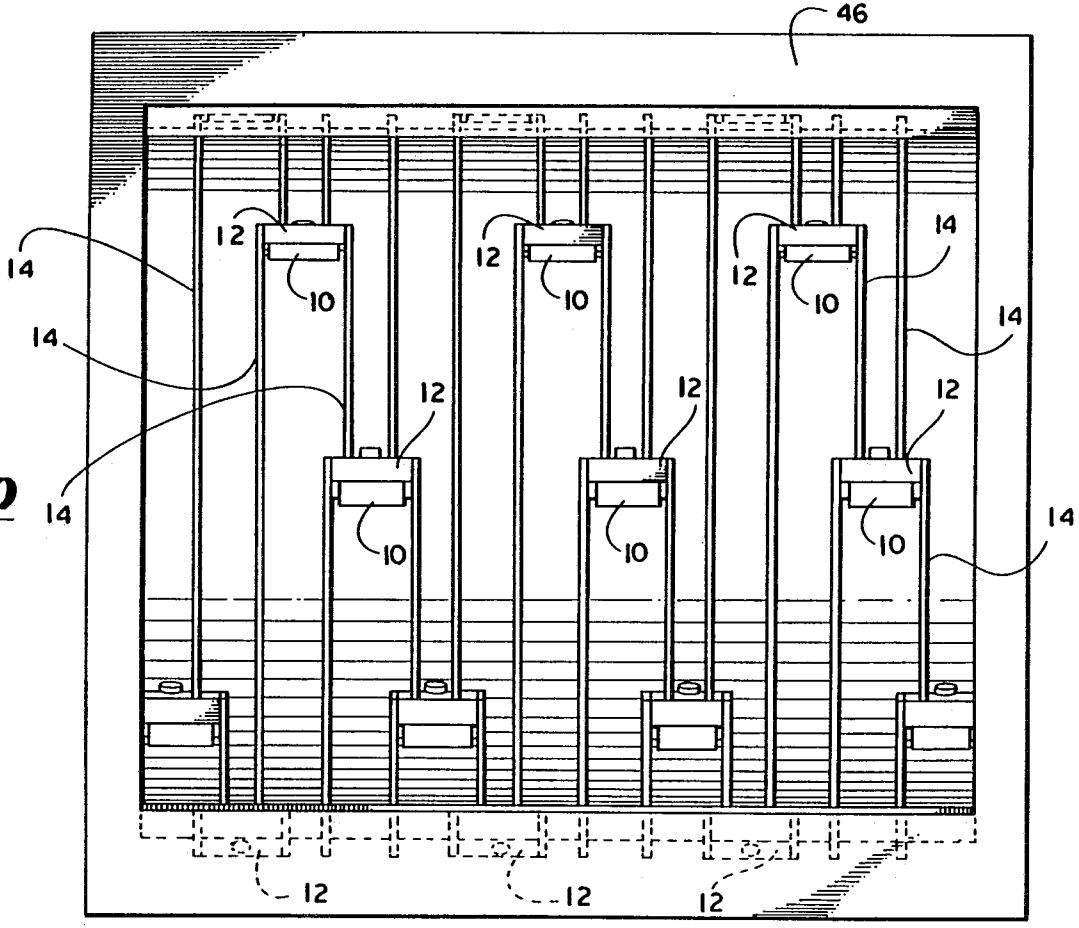
FIG. 10 is a top plan view of the wood cutting apparatus of the present invention.

Referring now to FIG. 10, it may be seen that the previously-discussed pattern allows the cutting members 10 to be helically positioned upon the supporting surface 16 of the drum 18, similarly to the positioning of the cutting members on the drum as disclosed in applicant's application No. 917,855, filed Oct. 14, 1986, incorporated herein by reference. As shown in FIG. 7, the ends of the cutting edges 34 of the cutting members 10 also line up such that wood inserted into the wood processing apparatus 100 is evenly consumed along the length of the drum. For example, one end of cutting edge 34*a* of cutting member 10*a* lies in approximately the same radial plane relative to the drum as one end of cutting edge 34*b* of cutting member 10*b*, as illustrated by dotted line L. Similarly, the opposite end of cutting edge 34*b* of cutting member 10*b* lines up with one end of cutting edge 34*c* of cutting member 10*c*, as illustrated by dotted line LL. This spacing relationship is repeated throughout the helically-positioned cutting members on the surface of the drum, such that the cutting edges of all of the cutting members 10 line up end-to-end with another cutting edge of another cutting member, except for cutting members positioned on the end of the drum, where as previously discussed the pattern is required to terminate.

WOOD PROCESSING APPARATUS

The drum configuration shown isolated in FIG. 6 is part of a wood processing apparatus shown as 100 in FIG. 8. The wood processing apparatus 100 includes a frame 46, a hopper 47, an anvil 45, first and second chip guides 49, 51, respectively, a separating grate 48, and an outlet port 52.

The hopper 47 is defined by the frame 46, which provides side walls, and the drum surface, which provides a floor. The anvil 45 is elongate, and has a substantially rectangular transverse cross-section. The anvil 45 is rigidly mounted to the frame 46 within a throat formed between the bottom of one of the hopper side walls and the surface of the drum, and is positioned adjacent to the mounting surface of the rotating drum 18 so that the longitudinal axis of the anvil is substantially parallel to the rotational axis of the rotating drum 18. As will be discussed later in this application, as the cutting members 10 pass alongside the anvil 45 during rotation of the rotating drum 18, the anvil 45 combines with the cutting members 10 to reduce the wood member 50 to wood chips 50'.

First and second chip guides 49, 51, respectively, are rigidly attached to the frame 46 and positioned beneath the rotating drum 18. The separating grate 48 is rigidly attached to the frame 46 and is positioned beneath the rotating drum 18 intermediate the first and second chip guides 49, 51. The separating grate 48 defines a plurality of sizing holes 44 which are configured to allow the passage of adequately-reduced wood chips, as discussed later in this application. On the trailing edge of each of the sizing holes 44 is positioned a grate knife 55 which extends outwardly from the separating grate 48 toward the drum 18. Together, the chip guides 49, 51 and separating grate 48 form a concentric partial sleeve spaced apart from the rotating drum and communicating at both ends with the input hopper 47.

A shaft 60 having a longitudinal axis substantially normal to the paper plane of FIG. 8 is rigidly mounted to the rotating drum 18 such that the ends of the shaft protrude from each end of the rotating drum 18, and the longitudinal axis of the shaft is substantially common to the longitudinal axis of the rotating drum. The ends of the shaft are captured within corresponding bearings (not shown) which allow the shaft and the rotating drum to be commonly rotated about their longitudinal axes. A motor (not shown) drives the shaft in a manner known in the art and is of sufficient power to drive the cutting members 10 through the typical wood members 50 as discussed later in the application.

Below the separating grate 48 is provided a wood chip removal means such as a conveyor (not shown), which serves to remove processed wood chips which exit from beneath the apparatus 100.

OPERATION OF THE WOOD PROCESSING APPARATUS

Prior to insertion of any of the typical wood members 50, the drum 18 is powered by a motor (not shown) such that the drum rotates in a counter-clockwise direction as viewed in FIG. 8. As previously discussed, the cutting members 10, support blocks 12, and ring segments 14 are rigidly positioned on and supported by the outside circumferential surface 16 of the rotating drum 18. Therefore it may be seen that as the drum 18 rotates, the cutting members 10, support blocks 12, and ring segments 14 likewise travel along an orbital path which passes alongside the anvil 45.

Upon rotation of the drum, a typical wood member 50 is placed into the hopper 47 of the wood processing apparatus 100 such that the wood member 50 contacts the upper surface 15 of one or more of the annular ring segments 14 but does not contact the exterior surface 16 of the drum 18. It may also be seen therefore that the ring segments maintain the wood member 50 in a spaced apart relationship from the supporting surface 16 of the rotating drum 18, such that a gap is maintained between the wood member and the surface of the drum 18. This gap includes the previously discussed gullets 40, which are positioned directly in front of each of the cutting members 10. It may be seen that the height of this gap is the same as the distance that the upper surface 15 extends from the surface of the drum. As previously discussed and as shown in FIG. 9, the blade 26 of the cutting member 10 protrudes above the ring segments relative to the supporting surface 16 of the drum. As the rotating drum 18 continues to rotate, eventually one of blades 26 of one the cutting members 10 comes in contact with the wood member 50. The wood member 50 is then drawn along with this blade 26 until the travel of the wood member 50 is halted by the stationary anvil 45. The power of the motor driving the blade 26, however, is sufficient to cause the blade to engage and be driven through the wood member 50 as shown most particularly in FIG. 9.

As shown in FIG. 9, it may be seen that when the cutting member 10 engages the wood member 50, the blade 26 performs the cutting action. The depth of cut of the blade 26 into the wood member 50 is limited, however, to the distance which the blade extends above the upper surface 15 of the ring members 14. This limiting action is an important feature of the invention, in that the power required to remove wood chips 50' from the wood member is correspondingly limited.

As the blade 26 of the cutting member 10 passes through the wood member, it may be seen that the leading face 28 of the blade directs wood being separated from the wood member by the cutting edge 34 into the gullet 40 positioned in front of the cutting member 10. The wood removed from the wood member may take the form of long splinters, as shown in FIG. 9, or may break up into smaller pieces, depending upon the properties of the wood being processed. These reduced wood elements, substantially smaller in size than the wood member 50, will be referred to as wood chips 50', although the term wood chip is intended to include any reduced wood element such as wood splinters, fibers, or flakes. As the cutting member 10 continues to engage and cut away at the wood member 50, it may be seen that wood chips 50' removed from the wood member also continue to pass into the gullet, pushing the wood chips already in the gullet further away from the cutting edge. Therefore it may be seen that wood chips 50' removed from the wood member 50 do not interfere in any way with the cutting of the wood member 50. This is an important advantage of the invention.

After the cutting members 10 exit the wood member 50, it may be seen that the distance which the wood member drops after each cut across its entire cross section is approximately equal to the depth of cut of the blade members 26, since the wood members 50 contact the rotating drum on the portions of the wood members which have just been previously cut by the blades 26. For blades as described above which extend a half inch above the upper surface 15 of the ring segments, the wood member drops about one-half inch.

Referring now again to FIG. 8, as the cutting member 10 passes through and exits the wood member 50, the wood chips 50' are drawn past the first chip guide 49 and toward the separating grate 48 by the cutting members 10 and by the influence of gravity. As the drum continues to rotate, the chips will be disposed atop the separating grate 48. Wood chips 50' which are sufficiently reduced in size to pass through the separating grate 48 do so and exit the wood processing apparatus 100. Wood chips 50' too large to pass through the separating grate 48 are then drawn across the separating grate by the cutting members 10.

As previously discussed, small grate cutting blades 55 extend upwardly from the drum-side surface of the separating grate 48. As the wood chips 50' are drawn across the grate 48, the wood chips are further processed by grate cutting blades 55 which extend upwardly from the separating grate 48 on the trailing lip of each of the sizing holes 44 in the grate 48. Therefore some wood chips 50' which were not initially small enough to pass through the separating grate 48 will be further processed by interaction of the cutting members 10 and the grate cutting blades 55 such that they may then pass through the separating grate 48.

The wood chips 50' too large to fall through the separating grate 48 even after such secondary processing are then dragged along the second chip guide 51 by the cutting members 10, and are then returned to the inlet hopper 47. These chips are then subjected to another processing cycle until sufficiently reduced in size to pass through the separating grate 48.

In the processing of wood, different types of wood behave differently when encountering cutting members such as that of the invention. For example some woods tend to fracture relatively easily after being removed from the main wood element. However, other types of wood do not break up as readily, and such woods tend to disadvantageously clog and jam wood processing machinery. The present invention contemplates the processing of such types of wood. As shown in FIGS. 2, 4, and 7, the width of the blades of the cutting members is slightly less than the width of the gullets 40. This allows wood chips 50' (which may have approximately the same width as the blades, depending upon the type of wood being processed) to pass freely within the gullets, instead of disadvantageously jamming in the gullets. This is an important feature of the invention.

Another advantage of the formation of a gullet in front of the cutting members is also apparent in light of the prior art. As previously discussed, prior art devices, although providing cavities in front of cutting members, did not provide cavities which were as effective as those of the present invention. As previously discussed, some of the prior art devices provide cavities which accept wood chips to be later discharged only after the associated cutting member exits a wood member. This configuration is disadvantageous in that such a cavity could become filled if the cutting member engages a very large wood member. In comparison, the applicant's gullet allows wood chips to be continuously pushed away from the cutting member, no matter how large the wood members are. The applicant's configuration similarly illustrates advantages over the drum configurations which allow chips to enter the drum, as it is apparent that such configurations require some means to remove the chips from within the drum, which will add expense and complexity to the devices. Finally, it may be seen that the applicant's gulleted configuration is less expensive to build as compared to other configurations, which require labor-intensive machining steps.

INSERTION OF WOOD MEMBERS INTO THE HOPPER

As previously discussed, the input hopper 47 is provided above the rotating drum 18 and accepts the wood products 50 to be processed by the wood processing apparatus 100. Referring now to FIG. 8, the wood members 50 may be inserted into the hopper by hand, if suitable safety precautions are provided, or larger wood members may be inserted into the hopper by conveyor, grapple, or other suitable means. If an exceptionally long wood member, such as a large tree, is to be inserted into the inlet hopper 47, this may be done by use of a grappler (not shown) which can grapple one end of a long wood member and feed the free end into the inlet hopper to be consumed by the wood processing apparatus 100. Long wood members may also be inserted into the inlet hopper 47 by attaching one end of a chain or wire rope (not shown) to one end of the wood member, attaching the other end of the chain or wire rope to the bucket of an end loader, and slowly lowering the free end of the wood member into the inlet hopper 47. When a sufficient length of the wood member has been consumed by the wood processing apparatus 100, the chain or wire rope may be removed, and the remainder of the wood member may then be dumped into the inlet hopper 47 to be completely consumed by the wood processing apparatus 100.

PART REPLACEMENT

After processing of wood for a time by the wood processing apparatus 100, the cutting edges 34 of the cutting members 10 may become chipped, broken, dulled, or otherwise degraded. The lifetime of the cutting edges depends upon the nature of the material being cut, and whether it includes soil, sand, rocks or debris with the wood. Degradation of the edges 34 decreases the efficiency of the wood processing apparatus 100, as more power is required to drive the cutting members 10 through the wood members. In this event, the wood processing apparatus 100 is turned off, and the degraded cutting members 10 are removed and replaced with new cutting members by simply removing the bolt 36, removing the degraded cutting member, and securing a new cutting member in its place. If desired, the cutting edges 34 of the degraded cutting members may then be resharpened. However, because of the manner in which the relatively small and simple cutting members 10 are manufactured, the applicant has found that it is more economically advantageous to fabricate new cutting members 10 instead of sharpening degraded cutting members, and therefore the cutting members can be treated as a disposable item.

The configuration of the wood processing apparatus of the present invention provides for effective on-site repair of the apparatus for most types of damage caused by encountering unprocessable material such as metal or stone. Should the damage be to the cutting members 10 only, the cutting members may be replaced as discussed above. However, should the damage be more extensive such as damage to a support block 12 or ring segment 14, such elements may still be replaced by one having a minimum of welding skills. For example, if a cutting member 10 encounters an object, it is possible that the associated support block 12 may be separated from the surface of the drum. It may also be possible that the ring segments 14 immediately behind the support block may also be separated from the surface of the drum. In this event it may be seen that the separated elements may simply be rewelded to the surface of the drum on site, if not unacceptably disfigured. If the elements are too badly disfigured, they may be discarded and replaced by spare elements on site. The cost of such replacement parts would not be too excessive to prohibit such a practice, and it may be seen that this type of repair requires a minimum of downtime and skilled labor. The advantages of such a surface-mount configuration are especially apparent when compared to other recessed-mount configurations, which can become severely damaged when encountering unprocessable material, resulting in excessive downtime and repair expenses.

SECOND EMBODIMENT

As shown in FIGS. 11 and 12, the configuration of the cutting members may be altered somewhat to allow the use of the cutting members with slotted anvils, while still falling within the spirit and scope of the present invention. As shown in FIG. 11, an alternate cutting member 130 defining a center slot generally at 132 includes a pair of outer blades 134 each defining an outer blade cutting edge 134E, and also includes a center blade 135 defining a center blade cutting edge 135E. The outer blade cutting edges 134E are substantially colinear and extend a first distance above the supporting surface 140. The center blade cutting edge 135E is parallel to the outer blade cutting edges 134E, but does not extend above the supporting surface 140 as far as the outer blade cutting edges, but instead extends a second distance above the supporting surface, being somewhat less than the first distance and somewhat greater than the distance the ring surface extends above the drum surface. A support block 131 having a similar slotted configuration and defining a slot generally at 133 is positioned behind the cutting member 130, similar to the positioning of the support block 12 relative to the cutting member 10 as discussed above. This slotted configuration allows for effective cutting and breaking up of wood members as the cutting member 130 engages a wood member, as three separate cross sections of wood are removed for each pass of the cutting member 130.

As shown in FIG. 12, the slotted configuration of the cutting member 130 and support block 131 allows the cutting member to be used in combination with a toothed anvil 150 similar to the anvils disclosed in applicantU.S. application Ser. No. 917,855. The slots 132, 133, defined by the cutting member 130 and support block 131, respectively, are configured to accept a typical tooth 137 of the slotted anvil 150, such that the center blade 135 passes under a corresponding tooth 137 of the anvil, and the center blade cutting edge 135E passes closely adjacent to but does not touch the associated tooth. The outer blades 134 pass alongside a tooth 137 of the toothed anvil 150 and within gaps 139 positioned in between the teeth of the anvil. It may be seen that this intimate cooperation between the cutting member 130 and the toothed anvil 150 allows for an effective reduction of wood which is processed by the alternate cutting member and the toothed anvil.

The slotted configuration of the alternate cutting member 130 also allows for intimate cooperation between the cutting member 130 and the previously-discussed grate cutting blades 55 which extend from the separating grate 48, as it may be seen that the grate cutting blades may be positioned such that they pass through the slot of the alternate cutting member during operation. This intimate relationship also allows for an effective reduction of wood which is processed by the alternate cutting member 130 and the grate cutting blades 55.

THIRD EMBODIMENT

Figure 13:
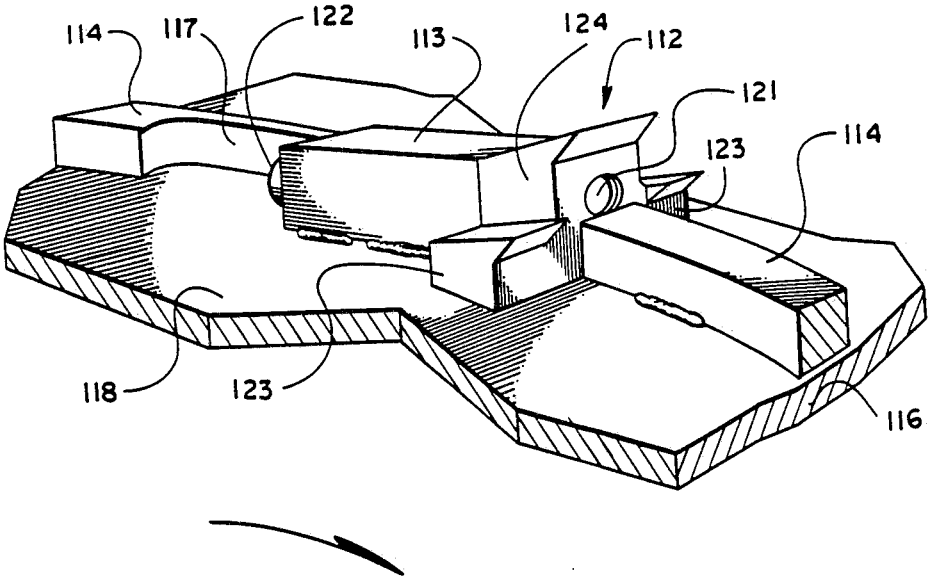
FIG. 13 is an isolated pictorial view of a third embodiment of the invention in which a modified cutting member is shown cooperating with an alternative ring segment configuration on the surface of the rotating drum.

Referring now to FIG. 13, another configuration falling within the spirit and scope of the present invention is shown which utilizes ring segments which cooperate with wood cutting members. Reference is now made to specific elements disclosed in applicant's pending application Ser. No. 917,855, filed Oct. 14, 1986, incorporated herein by reference, which discloses a winged hammer assembly including a cutting head and a body. The cutting head 112 (having a central cutting member 124 and two wing members 123) and body 113 shown in the present application are similar to the cutting head and body shown in the '855 application, and also are similarly fastened relative to a supporting surface 118 defined by a cylindrical drum 116. However, according to the present invention a ring segment 114 is further provided which has a first end abutting against the leading face of the cutting head 112. The ring segment 114 extends from its first end around the circumferential surface of the drum such that its second end is positioned behind the body 113. A small gap 117 is provided in the second end of the ring segment to allow the head 122 of the bolt 121 to be withdrawn. This ring segment 114 performs the same spacing function as that described previously with respect to the first preferred embodiment.

As the drum 116 is rotated along its longitudinal axis, and wood members (not shown) are introduced toward the circumferential surface of the drum, the ring segment 114 maintains a gap between the wood members and the surface 118. The maintenance of this gap prior to the cutting action is an important feature of the invention, as without the maintenance of the gap, the cutting head would be required to engage and remove an unacceptably large cross section of wood. This could result in part failure due to the initial shock of the cutting member first engaging the wood member, or could also result in inefficient cutting of the wood member, as the cutting member could "reject", or push away, the wood member, as previously discussed, if too much wood is allowed to build up in front of the cutting member.

As the cutting head 112 engages the wood member, it may seen that wood chips removed from the wood member may fall downward on each side of the ring segment 114 and into the gap between the wood member and the surface 118. In this embodiment, a single ring associated with each cutting head provides a gullet function. As the wood chips are removed, the wood member continues to fall downwardly toward the drum, until the wood member is finally consumed. The distance that the wood member falls after each cut depends upon the particular cutting head and ring configurations used. For example, if the difference in the height of the central member of the cutting head 122 and the height of the ring is greater than the height of the wing members 123, then the wood member will travel the distance of the height of the wing members after being cut, and will finally "bottom out" on the drum surface. However, if the difference in height of the central member of the cutting head 122 and the height of the ring is less than the height of the wing members, then the wood member will travel that difference in distances after each cut, and will finally "bottom out" on the upper surface of the ring.

It may be seen that the configuration shown in FIG. 13 may be achieved by retrofitting a machine having only the winged hammer assemblies mounted upon the drum surface (as disclosed in application no. 917,855) with the rings.

Therefore it may be seen that the present invention provides an apparatus which facilitates power-efficient cutting and shredding of wood products. It may also be seen that present invention provides a wood processing apparatus which does not become clogged with processed material. The wood processing machine is subject to a minimum of damage when encountering unprocessable foreign material, has disposable cutting members that can be replaced with a minimum of time and effort, is simple to operate, and inexpensive to purchase and maintain.

I claim:

1. An apparatus for processing wood, comprising:

a supporting surface;

spacing means mounted on said surface for maintaining a wood member spaced apart a first distance from said surface such that a gap is maintained intermediate said wood member and said surface;

a cutting element for removing wood from said wood member, said cutting element defining a cutting edge and being mounted to said surface such that said cutting edge is spaced apart from said surface a second distance from said surface, said second distance being greater than said first distance;

means for urging said cutting member along a cutting path relative to said wood member such that said cutting edge engages said wood member and removes a wood chip; and means for directing said wood chip into said gap and away from said cutting edge.

2. The apparatus of claim 1, wherein said spacing means is a spacing element attached to said surface.

3. The apparatus of claim 1, wherein said spacing means comprises a spacing element defining an upper surface spaced said first distance from said supporting surface.

4. The apparatus of claim 3, wherein said spacing means is a ring segment, and said ring segment defining said upper surface such that said upper surface is substantially parallel to said supporting surface.

5. The apparatus of claim 1, wherein said cutting member includes a heel face and a leading face, said heel face and said leading face intersecting to define said cutting edge, and wherein said means for urging said wood chip into said gap and away from said cutting edge is said leading face.

6. The apparatus of claim 4, wherein said cutting member includes a heel face and a leading face, said heel face and said leading face intersecting to define said cutting edge, and wherein said means for urging said wood chip into said gap and away from said cutting edge is said leading face.

7. An apparatus for processing wood, comprising:

a supporting surface;

a pair of spacing elements mounted on said surface for maintaining a wood member spaced apart a first distance from said surface, said spacing elements and said surface combining to define a gullet having a depth of said first distance;

a cutting element positioned within said gullet and having a cutting edge extending a second distance apart from said surface, said second distance being greater than said first distance, such that the depth of cut of said cutting element into said wood member is generally the difference in said second and said first distances;

means for urging said cutting member relative to said wood member such that said cutting edge engages said wood member and removes a reduced wood element from said wood member, and means for directing said reduced wood element into said gullet and away from said cutting edge.

8. The apparatus for processing wood as claimed in claim 7, wherein said cutting element is attached to said surface.

9. The apparatus for processing wood as claimed in claim 8, wherein each of said spacing elements defines an upper shelf spaced said first distance from said surface.

10. The apparatus of claim 9, wherein each of said shelves is substantially parallel to said surface.

11. The apparatus of claim 10, wherein said spacing elements are annular ring segments.

12. The apparatus of claim 7, wherein said cutting element defines a cutting edge, and wherein said spacing elements are spaced apart a distance greater than the length of said cutting edge, such that said reduced element does not become jammed between said spacing elements after being removed from said wood member.

13. An apparatus for processing wood, comprising:

a cylindrical drum mounted for rotation about its longitudinal axis;

a cutting member having a cutting edge;

means for mounting said cutting member upon the circumferential surface of said drum such that said cutting edge is positioned a first distance from said circumferential surface;

means for rotating said drum such that said cutting element passes along a circular path concentric to the surface of said drum;

a pair of parallel elongate ring sections each having a first and a second end and a substantially uniform cross section, and having an arcuate configuration along their length substantially conforming to the circumferential surface of the surface of said drum, said first ends of each of said spacing elements being positioned laterally adjacent to the path of travel of said cutting member, and extending in parallel relationship in front of said cutting member such that a gullet is defined in front of said cutting edge by said cutting member, said ring sections, and said surface.

* * * * *